US010871039B2

(12) United States Patent
Maw

(10) Patent No.: US 10,871,039 B2
(45) Date of Patent: Dec. 22, 2020

(54) REPLACEABLE NOZZLE FOR DRILLING BIT

(71) Applicant: Ulterra Drilling Technologies, L.P., Fort Worth, TX (US)

(72) Inventor: Jason Maw, Beaumont (CA)

(73) Assignee: Ulterra Drilling Technologies, L.P., Fort Worth, TX (US)

( * ) Notice: Subject to any disclaimer, the term of this patent is extended or adjusted under 35 U.S.C. 154(b) by 0 days.

(21) Appl. No.: 16/239,392

(22) Filed: Jan. 3, 2019

(65) Prior Publication Data

US 2020/0217144 A1 Jul. 9, 2020

(51) Int. Cl.
*E21B 10/61* (2006.01)
*E21B 10/60* (2006.01)

(52) U.S. Cl.
CPC ..... *E21B 10/61* (2013.01); *E21B 10/602* (2013.01)

(58) Field of Classification Search
CPC ..... E21B 10/61; E21B 10/602; E21B 10/607; B05B 15/65; B05B 15/60
USPC ..... 239/600
See application file for complete search history.

(56) References Cited

U.S. PATENT DOCUMENTS 4,878,548 A * 11/1989 Ostertag ..... E21B 10/61 175/340
5,655,614 A * 8/1997 Azar ..... E21B 10/04 175/404
10,053,916 B2 * 8/2018 Yu ..... C22F 1/006
2009/0020334 A1 * 1/2009 Gavia ..... E21B 41/0078 175/57
2015/0047912 A1 * 2/2015 Pettiet ..... E21B 10/43 175/428
2015/0368979 A1 12/2015 Casad

FOREIGN PATENT DOCUMENTS

GB 2324109 10/1998

OTHER PUBLICATIONS

International Application No. PCT/US2019/068895, "International Search Report and Written Opinion", dated Apr. 1, 2020, 10 pages.

* cited by examiner

*Primary Examiner* — Giovanna Wright
*Assistant Examiner* — Yanick A Akaragwe
(74) *Attorney, Agent, or Firm* — Kilpatrick Townsend & Stockton LLP

(57) ABSTRACT

A nozzle for a drill bit such as may be used to drill for oil or natural gas. The nozzle includes a generally-cylindrical body having a longitudinal axis, a proximal end for insertion into a drill bit body, and a distal end opposite the proximal end. The nozzle body defines a longitudinal bore through the nozzle along the longitudinal axis. The nozzle further includes one or more lobes extending radially from the nozzle body near the distal end. Each of the lobes is displaced axially from the distal end such that a cylindrical portion of the nozzle body is disposed between the distal end and the lobe. The nozzle further includes a fitting in the distal end configured to engage a tool for imparting rotational torque to the nozzle about the longitudinal axis. Such a nozzle is preferably insertable into a drill bit body from outside the body.

21 Claims, 9 Drawing Sheets

REPLACEABLE NOZZLE FOR DRILLING BIT

FIELD OF THE INVENTION

Embodiments of the invention relate to drill bits such as may be used to drill for oil or water, or for exploration or other purposes.

BACKGROUND OF THE INVENTION

FIG. 1 illustrates a highly simplified schematic diagram of a drilling apparatus 100 such as may be used to drill for oil or water, or used for exploration or other purposes. A drill bit 101 is rotated while being advanced into a rock formation 102, to create a borehole 103. The drill bit 101 is mounted to a drill string 104 within the borehole 103. The bit 101 may be, for example, a traditional roller cone bit, or a drag bit such as a polycrystalline diamond compact (PDC) bit.

The drill string 104 is made up of sections of pipe 105. As the borehole 103 deepens, pipe sections 105 are sequentially added to the top of the drill string 104 by workers operating a derrick 106. The derrick 106 includes a draw works 107 for supporting the drill string 104 and regulating the force with which the bit 101 contacts the formation, known as "weight on bit" or WOB. The draw works 107 may also be used for "tripping" the drill string 104 out of the borehole 103 when the drill bit 101 must be replaced, and for removing the drill string 104 from the borehole 103 upon completion of the well.

The drilling apparatus 100 also maintains a supply of drilling fluid, also known as "mud," and a pump 108 for pumping the drilling fluid down the drill string 104. The drilling fluid flows into the drill bit 101 from the drill string 104, out through ports in the drill bit 101 into the borehole 103, and back up the annulus of the borehole 103 to the surface. The drilling fluid may serve a number of purposes, for example to lubricate and cool the drill bit 101, to stabilize the borehole 103, and to carry the cuttings from the bottom of the borehole 103 back to the surface, where they can be filtered from the drilling fluid and collected. The filtered drilling fluid may be reused.

The drilling apparatus 100 also includes a mechanism (not shown) for causing the drill bit 101 to rotate against the formation 102. In some cases, the derrick 106 includes a motorized drive that turns the top of the drill string 104, such that the rotation of the drill string 104 drives the drill bit 101 to rotate. In other systems, the hydraulic pressure of the drilling fluid is used to turn a "mud motor" at the bottom of the drill string 104, before the drilling fluid is supplied to the drill bit 101.

FIG. 2 illustrates a drag bit 200 in more detail. The drag bit 200 includes a body 201, which may be made of steel, a tungsten matrix, or another material. The bit body 201 is typically cast or milled as a single piece. The bit body 201 includes a number of blades 202. A number of ports 203 provide passageways for drilling fluid to flow from an interior plenum of the bit 200 to spaces 204 between the blades 202. The spaces 204 are often called junk slots, as they provide a route for the drilling fluid to carry cuttings to the annulus of the borehole 103.

A number of cutters 205 are fixed to the blades 202, and are the part of the bit 200 that actually contacts and fails the formation 102. Each of the cutters 205 is typically made of a sintered polycrystalline diamond table bonded to a cylindrical tungsten carbide substrate. The cutters 205 are typically brazed into the blades 202.

Hardened nozzles such as nozzles 206 and 207 may be placed in the ports 203, to reduce erosion or wear of the bit body 201 from the drilling fluid. In the example bit 200, the nozzle 206 is threaded into the bit body 201 from outside the body 201, as shown in more detail in FIG. 2A. The nozzle 207 is inserted into its port from the plenum inside the bit and brazed in place, as shown in more detail in FIG. 2B. The nozzle 207 and its receptacle in the bit 200 may be tapered or a ledge or other feature provided in the bit 200, so as to prevent the nozzle 207 from passing out of the bit 200.

Improved nozzle configurations are desired.

BRIEF SUMMARY OF THE INVENTION

According to one aspect, a nozzle for a drill bit comprises a nozzle body, wherein the nozzle body is generally cylindrical and comprises a longitudinal axis, a proximal end for insertion into a drill bit body, and a distal end opposite the proximal end. The nozzle body defines a longitudinal bore through the nozzle along the longitudinal axis. The nozzle further comprises one or more lobes extending radially from the nozzle body near the distal end. Each of the one or more lobes is displaced axially from the distal end such that a cylindrical portion of the nozzle body is disposed between the distal end and the lobe. The nozzle further comprises a fitting in the distal end configured to engage a tool for imparting rotational torque to the nozzle about the longitudinal axis.

According to another aspect, a drill bit comprises a nozzle, a drill bit body, and a plurality of cutters on the drill bit body. The nozzle further comprises a nozzle body, wherein the nozzle body is generally cylindrical and comprises a longitudinal axis, a proximal end for insertion into a drill bit body, and a distal end opposite the proximal end, and wherein the nozzle body defines a longitudinal bore through the nozzle along the longitudinal axis. The nozzle further includes one or more lobes extending radially from the nozzle body near the distal end, wherein each of the one or more lobes is displaced axially from the distal end such that a cylindrical portion of the nozzle body is disposed between the distal end and the lobe. The nozzle further includes a fitting in the distal end configured to engage a tool for imparting rotational torque to the nozzle about the longitudinal axis. The drill bit body comprises an exterior surface and an interior plenum, and the drill bit body defines a port through the drill bit body from the exterior surface to the interior plenum, the port being generally cylindrical and of a size to receive the nozzle body. The port has an undercut groove defining an enlarged section of the port, the groove being of a size to receive the one or more lobes of the nozzle within the groove. The drill bit body defines one or more gaps in the nozzle body positioned at an edge of the port, the one or more gaps being of a shape and size to receive the one or more lobes of the nozzle. The nozzle is disposed in the drill bit body with the lobes captured within the undercut groove.

According to another aspect, a method of installing a nozzle in a drill bit comprises providing a nozzle and a drill bit body. The nozzle comprises a nozzle body, wherein the nozzle body is generally cylindrical and comprises a longitudinal axis, a proximal end for insertion into a drill bit body, and a distal end opposite the proximal end, and wherein the nozzle body defines a longitudinal bore through the nozzle along the longitudinal axis. The nozzle further includes one or more lobes extending radially from the nozzle body near the distal end, wherein each of the one or more lobes is displaced axially from the distal end such that a cylindrical portion of the nozzle body is disposed between the distal end and the lobe. The nozzle further includes a fitting in the distal end configured to engage a tool for imparting rotational torque to the nozzle about the longitudinal axis. The drill bit body comprises an exterior surface and an interior plenum, and the drill bit body defines a port through the drill bit body from the exterior surface to the interior plenum, the port being generally cylindrical and of a size to receive the nozzle body. The port has an undercut groove defining an enlarged section of the port, the groove being of a size to receive the one or more lobes of the nozzle within the groove. The drill bit body also defines one or more gaps in the nozzle body positioned at an edge of the port, the one or more gaps being of a shape and size to receive the one or more lobes of the nozzle. A plurality of cutters are on the drill bit body. The method further comprises inserting the nozzle into the port defined in the drill bit body from outside the drill bit body such that the one or more lobes pass through the gaps to reach the groove; rotating the nozzle about its longitudinal axis such that the one or more lobes of the nozzle are axially captured within the groove; and brazing the nozzle to the drill bit body.

DETAILED DESCRIPTION OF THE INVENTION

Prior drill bit nozzle configurations have certain disadvantages. For example, nozzles threaded into a bit body from outside the body require space for the threads themselves and also for the tools used to turn the nozzles into the threaded ports. Leaving room between the blades of a drill bit for such nozzles may become an undesirable constraint on drill bit design, as drill bit designs evolve to improve cutting performance. For example, it may be desirable to design bits with more blades or blades with more complex shapes, leaving less room between the blades for nozzle insertion.

Nozzles that are inserted from inside the bit plenum and brazed in place may provide more blade design flexibility, but are difficult to install, and may place constraints on the design of the interior of the bit, and on where the nozzles can be placed.

Figure 1:
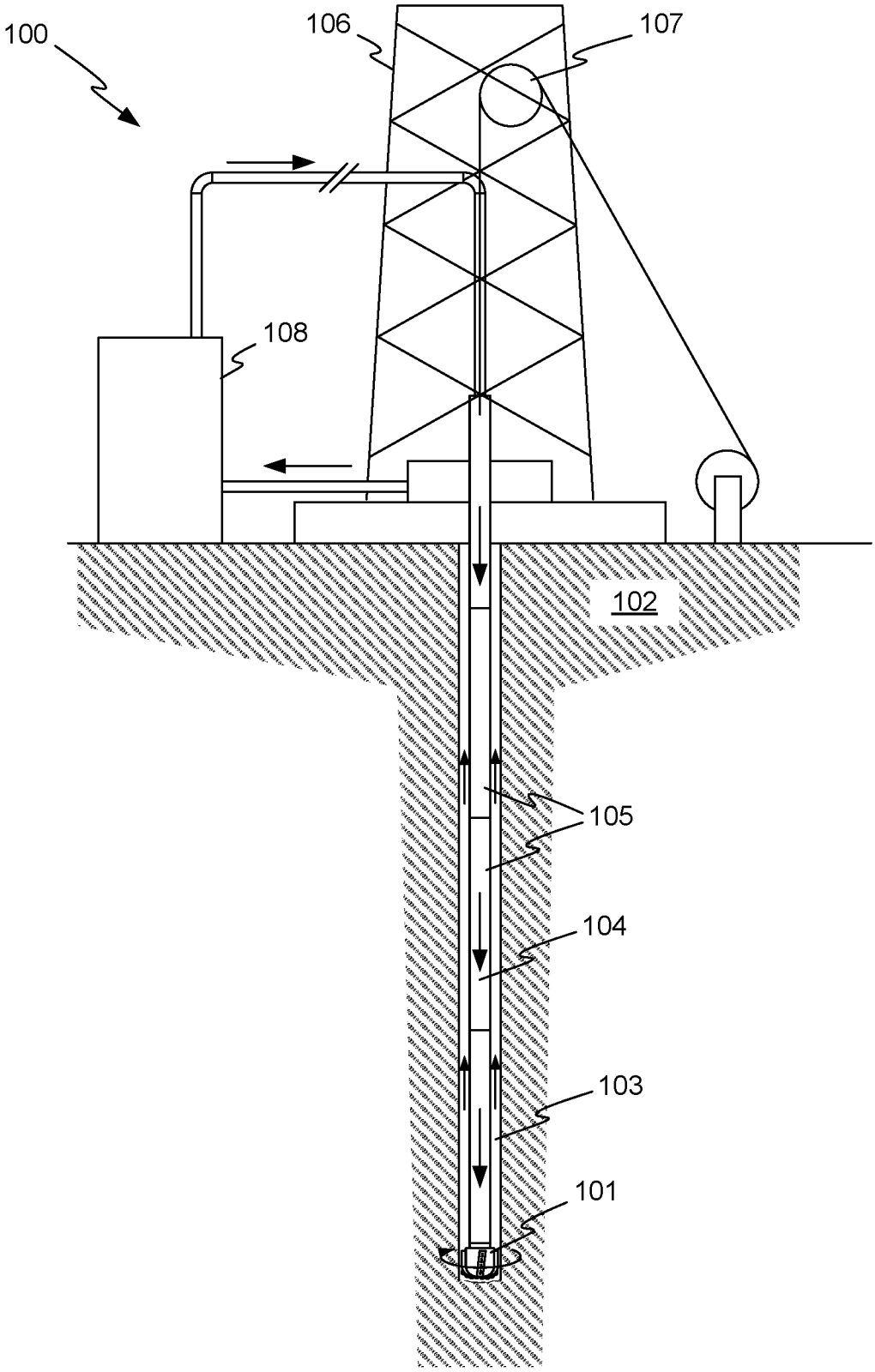
FIG. 1 illustrates a highly simplified schematic diagram of a drilling apparatus such as may be used to drill for oil or water, or used for exploration or other purposes.
Figure 2:
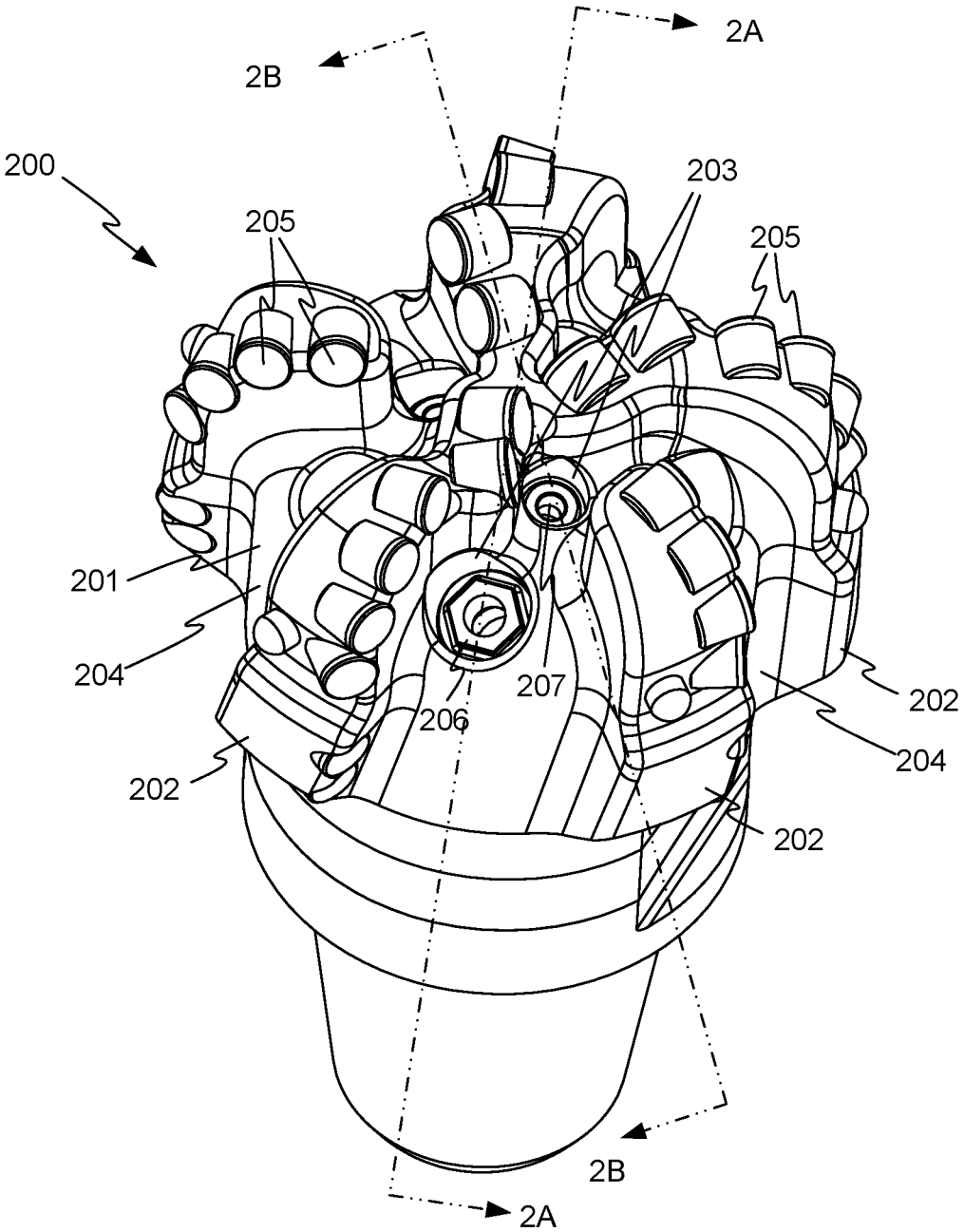
FIG. 2 illustrates a drag bit.
Figure 2A:
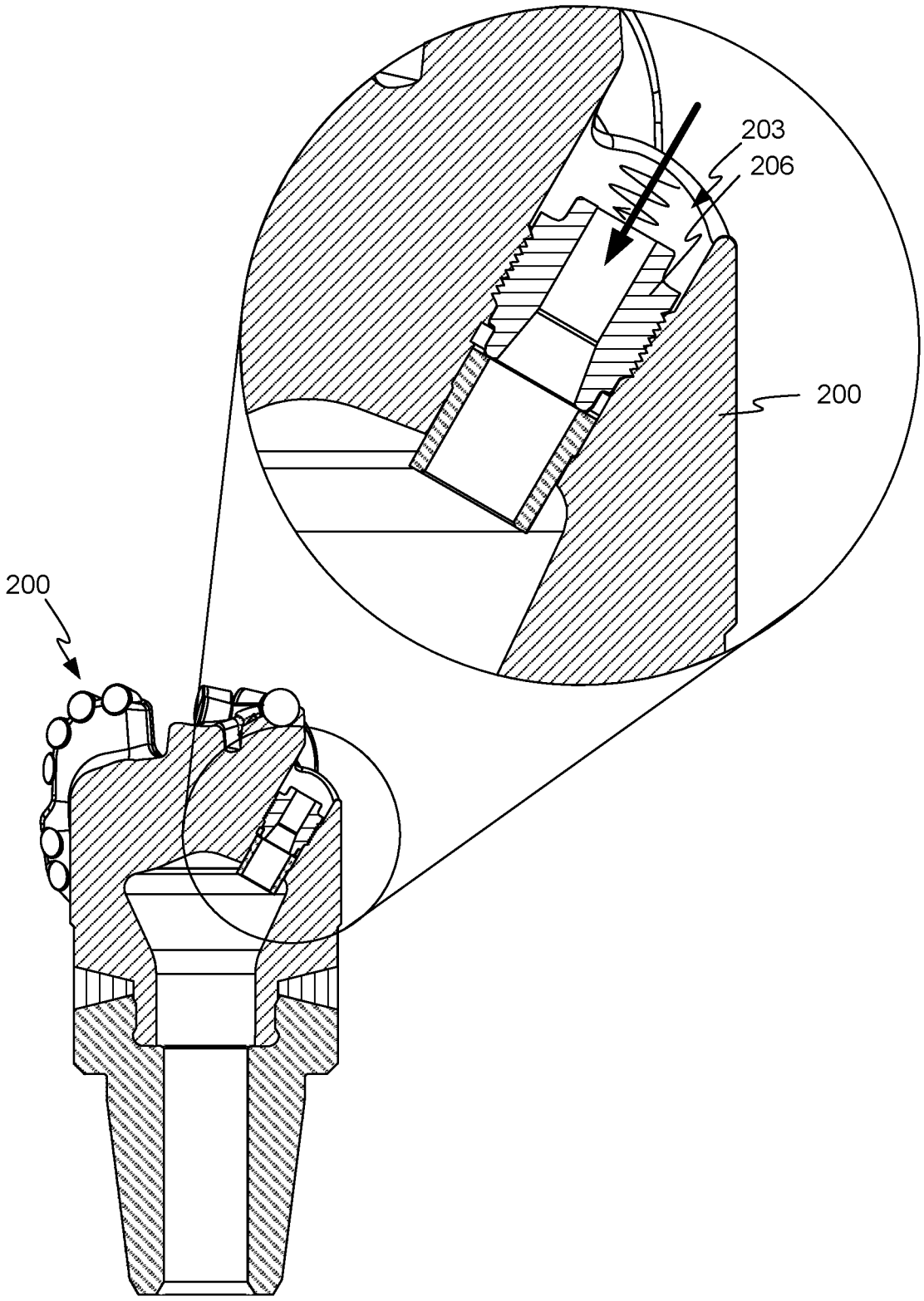
FIG. 2A illustrates a cross section view of the drag bit of FIG. 2.
Figure 2B:
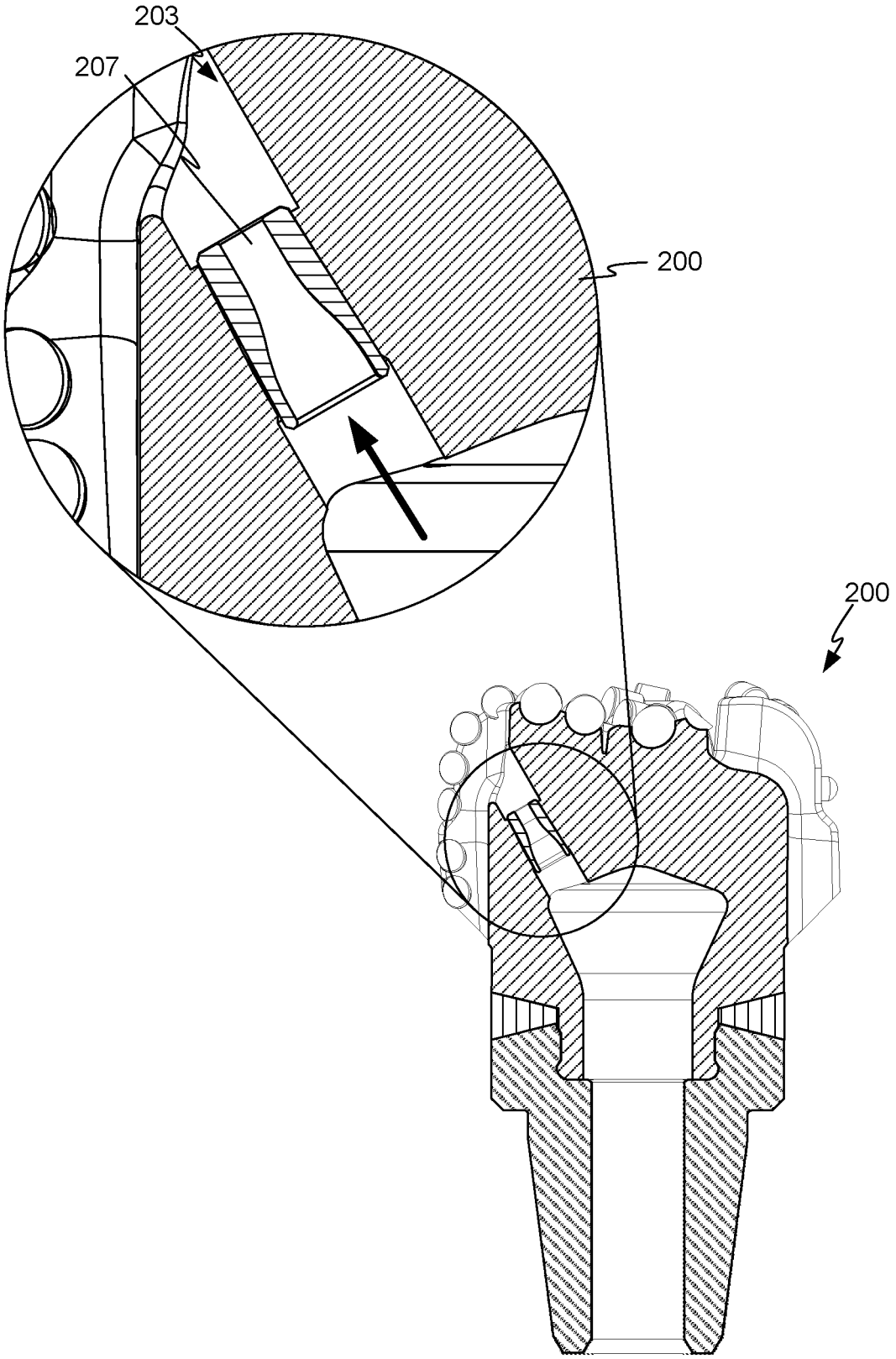
FIG. 2B illustrates another cross section view of the drag bit of FIG. 2.
Figure 3:
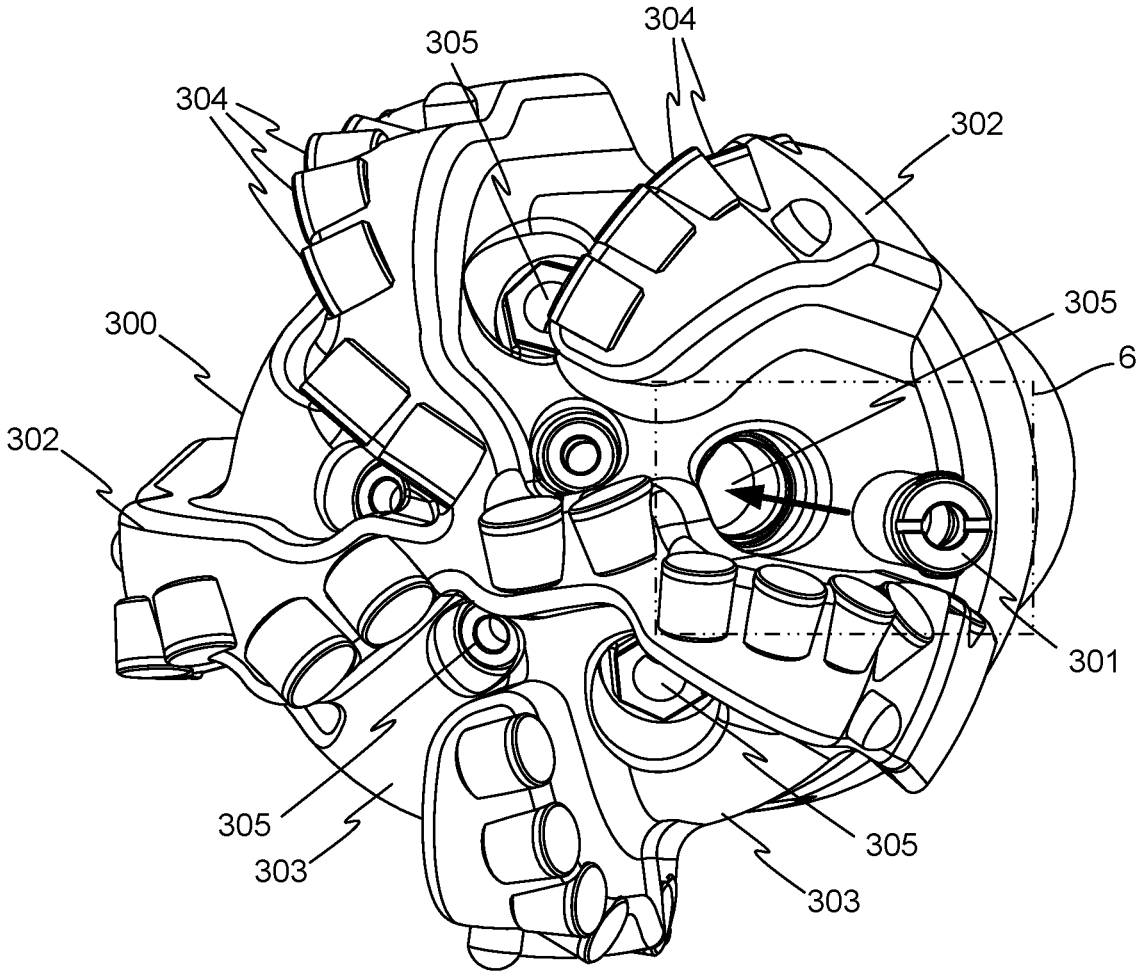
FIG. 3 illustrates a drill bit and a nozzle in accordance with embodiments of the invention.

FIG. 3 illustrates a drill bit 300 and a nozzle 301 in accordance with embodiments of the invention. The drill bit 300 includes several features typical of a PDC drag bit, including blades 302, junk slots 303, and cutters 304. In addition, the drill bit 300 includes a number of ports 305 providing passages from the junk slots 303 to the interior plenum of the bit 300.

As is described in more detail below, the nozzle 301 and the ports 305 are not threaded. Rather, the nozzle 301 smooth-sided and is intended to be installed in the bit 300 by brazing. Additional security in mounting the nozzle 301 to the bit 300 may be provided by interlocking features on the nozzle 301 and the bit 300. This arrangement may enable more efficient use of the "real estate" in the junk slots, because the ports 305 may be smaller than threaded ports, and no clearance may be needed for tools to install the nozzle 301. Consequently, nozzles according to embodiments of the invention may enable more flexibility in bit design, especially for small-diameter bits, and bits with higher numbers of blades. Nozzles according to embodiments of the invention may be especially applicable to bits having complex blade arrangements, such as the "split" blade designs described in U.S. Patent Application Publication No. 2015/036879 of Casad, the entire disclosure of which is hereby incorporated by reference herein for all purposes.

Figure 4:
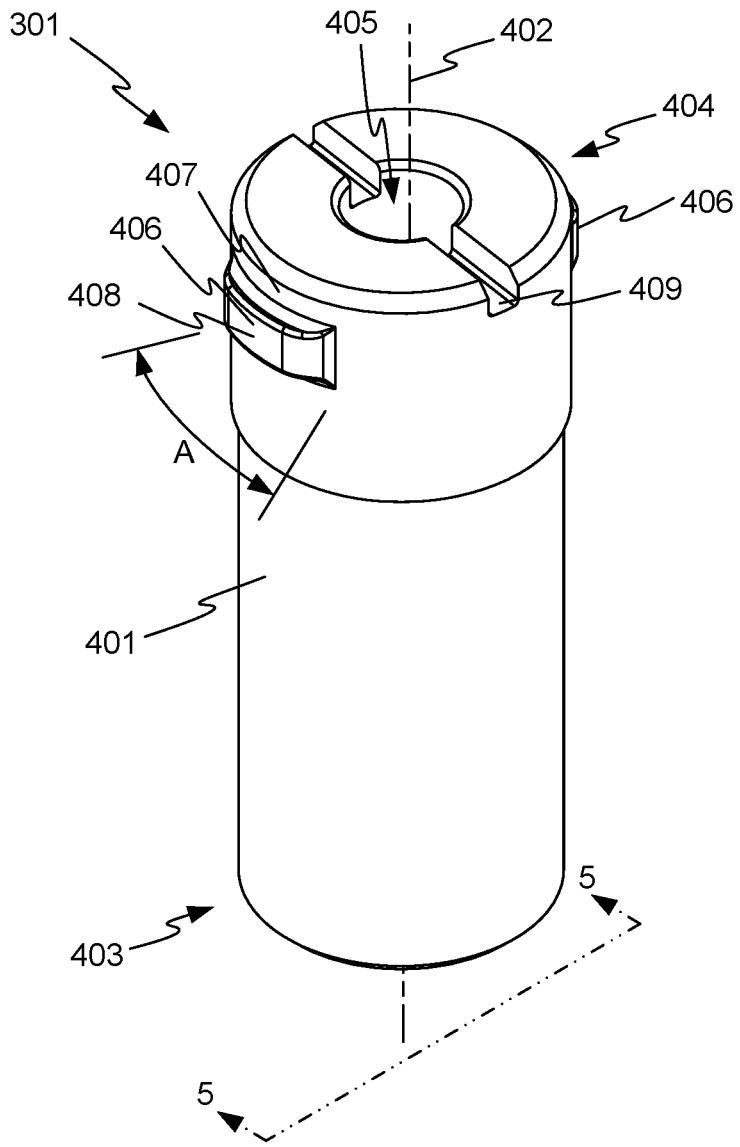
FIG. 4 illustrates the nozzle of FIG. 3 in more detail.

FIG. 4 illustrates the nozzle 301 in more detail, in accordance with embodiments of the invention. The nozzle 301 includes a generally-cylindrical body 401 having a longitudinal axis 402. The nozzle body 401 has a proximal end 403 configured for insertion into a bit body, and a distal end 404 opposite the proximal end 403. The nozzle body 401 defines a longitudinal bore 405 through the nozzle 301 along the longitudinal axis 402.

The nozzle 301 also includes one or more lobes 406 extending radially from the nozzle body 401 near the distal end 404. The nozzle 301 may preferably have two lobes diametrically opposed on the nozzle body 401, but a nozzle embodying the invention may also have more than two lobes 406. The lobe 406 is displaced axially from the distal end 404, such that a cylindrical portion 407 of the nozzle body 401 is disposed between the lobe 406 and the distal end 404.

Although any suitable lobe shape may be used, the outer surface 408 of the lobe 406 may be a portion of a cylinder, centered on the longitudinal axis 402 of the nozzle body 401 and having a larger radius than the portion of the nozzle body from which the lobe 406 extends. For example, the lobe 406 may extend from the outer cylindrical surface of the nozzle body 401 by about 0.020 to 0.100 inches or another suitable distance. In one particular embodiment, each lobe extends from the outer cylindrical surface of the nozzle body 401 by about 0.037 inches. The angular extent A of the lobe 406 may be any suitable value, but in some embodiments may be between 30 and 60 degrees as measured around the longitudinal axis 402 of the nozzle.

The example nozzle 301 also has a recess 409 in the distal end 404, shaped to accept a tool for applying torque to the nozzle 301. The recess 409 is an example of a fitting for accepting a tool. In the example of FIG. 4, the recess 409 is a simple transverse slot such as may accept a flat screwdriver blade or another similar tool. In other embodiments, the recess 409 may have another shape, for example a polygonal shape. In some embodiments, the recess 409 may be a hexagonal recess such as may accept an Allen wrench or similar tool. Many other recess shapes are possible. In other embodiments, the fitting may be a raised feature, for example a raised hexagon as may engage with a socket wrench.

The nozzle 301 may be made of any suitable material, for example sintered tungsten carbide so as to withstand the rigors of the downhole environment.

Figure 5:
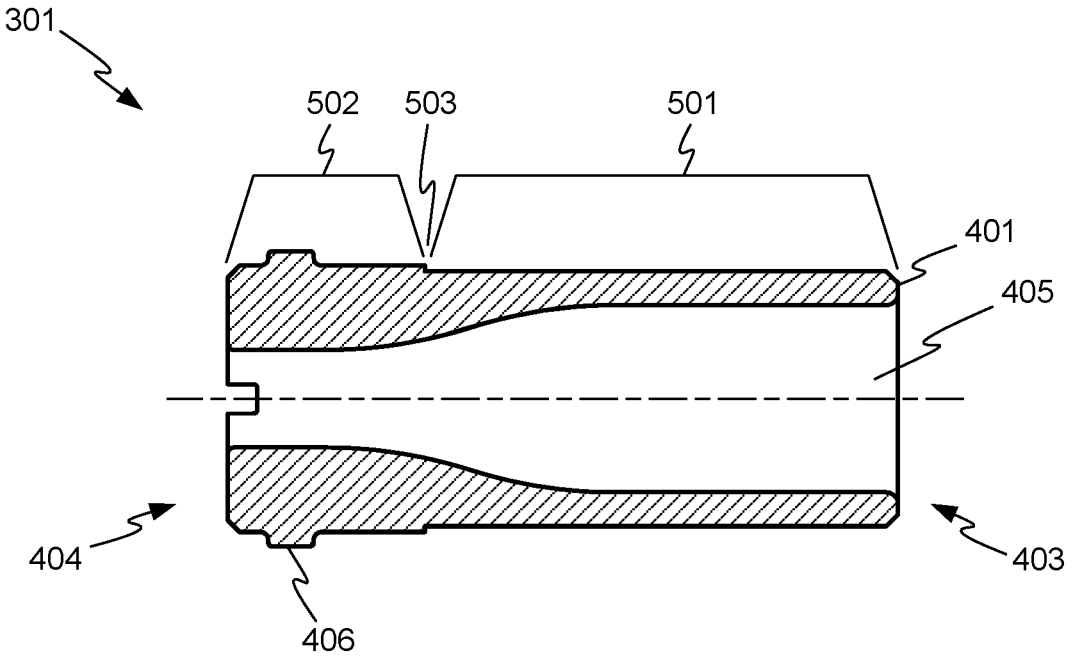
FIG. 5 shows a cross section of the nozzle of FIG. 3.

FIG. 5 shows a cross section of the nozzle 301. As is visible in FIG. 5, the nozzle 301 may have a first portion 501 at the proximal end 403 and a second portion 502 at the distal end 404, with the first portion 501 having a slightly smaller radius than the second portion 502. The two portions meet at an intermediate location 503 between the proximal end 403 and the distal end 404. The transition between the first portion 501 and the second portion 502 may be a step transition in radius or may have another shape, for example a 45-degree angle, but the transition is preferably relatively sharp in relation to the difference in diameters between first portion 501 and the second portion 502. The purpose of the transition is explained in more detail below.

FIG. 5 also reveals additional details of the longitudinal bore 405, in accordance with embodiments of the invention. The longitudinal bore 405 is preferably larger in cross sectional area at the proximal end 403 of the nozzle 301 than at the distal end 404. While any suitable dimensions may be used, the longitudinal bore 405 may have a diameter at the proximal end up to 70 percent or more of the outside diameter of the nozzle body 401 at the proximal end 403. Thus, the wall thickness of the of the nozzle body 401 at the proximal end may be as little as 15 percent or less of the diameter of the nozzle body, such that the nozzle 301 does not require excessive space within the bit body to accommodate the size of the longitudinal bore 405. For the purposes of this disclosure, references to the "diameter of the nozzle body at the proximal end" and the like refer to the outer diameter of the cylindrical surface of the nozzle body at its nearest point to the end of the nozzle, disregarding any chamfers or radii on edges of the nozzle body.

The cross sectional area of the longitudinal bore 405 may be smaller at the distal end 404 of the nozzle body 401 than at the proximal end 403. Preferably the transition from the larger cross sectional bore area at the proximal end 403 to the smaller cross sectional bore area at the distal end 404 is made smooth to promote smooth flow of the drilling fluid through the nozzle 301. Nozzles such as nozzle 301 may be provided with a range of distal (outlet) end bore diameters, for example ranging from about 25 percent or less to about 70 percent or more of the nozzle body diameter, and a nozzle with a particular outlet bore size may be selected and installed in the bit based on the expected drilling conditions. For example, a nozzle that is too large may result in slow flow of drilling fluid through the nozzle, such that cuttings are not cleanly removed from the drilling face. Conversely, a nozzle that is too small may result in very fast flow of drilling fluid through the nozzle, risking erosion of the drill bit or other damage. The required volumetric flow of drilling fluid may be a function of the diameter of the borehole, and other factors.

The dimensions of the nozzle 301 may also be selected based on the size and configuration of the bit into which the nozzle 301 is to be installed. While any suitable dimensions may be used, in some embodiments, the outer diameter of the second portion 502 of the nozzle 301 may be between 0.5 and 1.0 inches, and the overall length of the nozzle 301 may be between 1.0 and 2.5 inches. In one particular embodiment, the outer diameter of the second portion 502 is about 0.682 inches, the bore diameter at the proximal end is about 0.480 inches, the overall length of the nozzle 301 is about 1.70 inches, and the bore diameter at the distal (outlet) end may be between about 0.188 and 0.437 inches.

Figure 6:
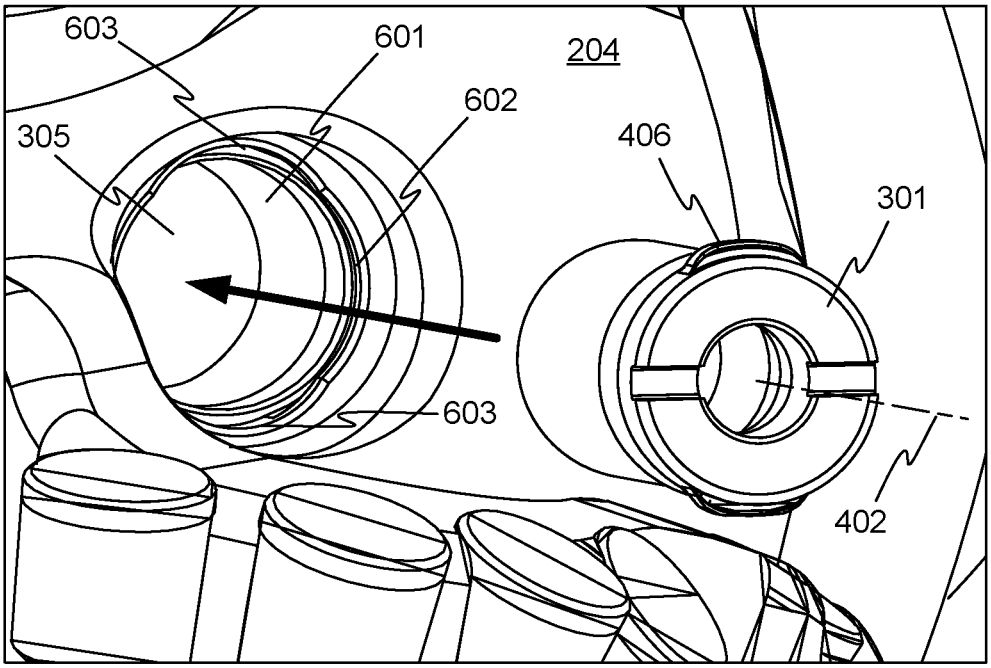
FIG. 6 shows a portion of the drill bit of FIG. 3 in more detail.

FIG. 6 shows a portion of the drill bit 300 in more detail, including one of ports 305 providing a passage through the body to the interior plenum of the bit 300. The nozzle 301 is poised to be inserted into one of the ports 305. The port 305 has a cylindrical inner face of smoother bore 601 and an undercut groove 602. A number of gaps 603 provide access for the lobes 406 of the nozzle 301 to reach the undercut groove 602. Once the nozzle 301 has been inserted until the lobes 406 align with the undercut groove 602, the nozzle 301 can be rotated about its longitudinal axis 402 so that the lobes 406 are captured in the undercut groove 602.

In some embodiments, the gaps 603 may be arranged so that they fall near the center of the corresponding junk slot 204, rather than being adjacent to the edges of the junk slot. That is, the gaps 603 may be arranged longitudinally within the junk slot, rather than transversely to the junk slot. The longitudinal arrangement ensures that the gaps 603 do not themselves become a constraint on the width of the junk slot, and may permit the design of bits having the narrowest possible junk slots.

Figure 7:
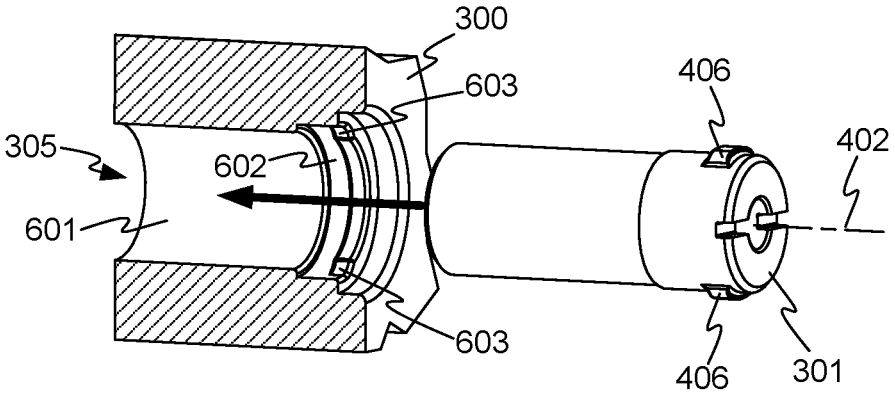
FIG. 7 illustrates a simplified cutaway portion of the bit of FIG. 3 with the nozzle poised for insertion into a port in the bit.

FIG. 7 illustrates a cutaway portion of the bit 300 with the nozzle 301 poised for insertion into one of the ports 305. The bit 300 is somewhat simplified in FIG. 7 for ease of illustration. The smooth bore 601 and the undercut groove 602 are visible, as well as the gaps 603 in the outer wall of the undercut groove 602.

Figure 8:
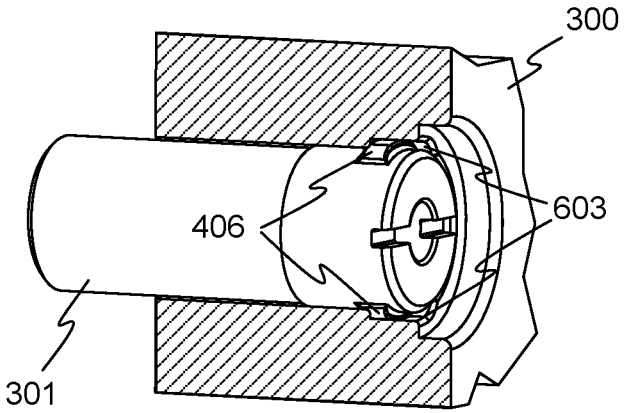
FIG. 8 shows the cutaway portion of the bit with the nozzle inserted into the port.

FIG. 8 illustrates the cutaway portion of the bit 300 with the nozzle 301 inserted into the port 305, so that the lobes 406 have passed through the gaps 603, and are aligned with the undercut groove 602.

Figure 9:
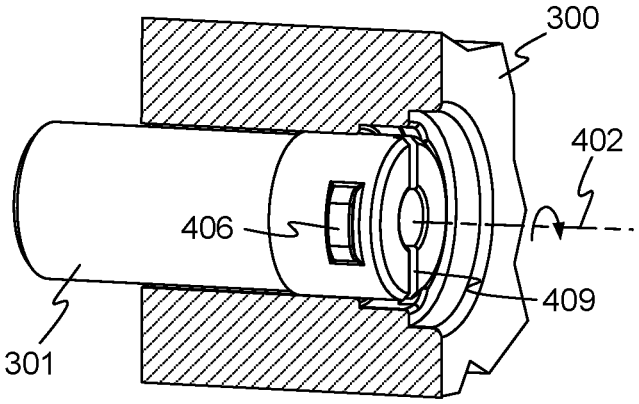
FIG. 9 shows the same view as FIG. 8, but after the nozzle has been rotated 90 degrees about its longitudinal axis.

FIG. 9 illustrates the same view as FIG. 8, but after the nozzle 301 has been rotated 90 degrees about its longitudinal axis 402 so that the lobes 406 are captured within the undercut grooves 602, preventing direct removal of the nozzles. Once inserted, the nozzle 301 is preferably brazed in place. The combination of the brazing and the capture of the lobes 406 within the undercut grooves 602 securely attaches the nozzle to the body of the drill bit 300.

The brazing process may be carried out in any workable manner, but in some embodiments, a silver braze may be used because of its good wetting properties on tungsten carbide. The nozzle 301 is preferably coated in flux and inserted into a respective port 305. The nozzle and bit body are heated to a temperature sufficient to melt the brazing, which flows into the gap between the nozzle and the bit body by capillary action. For silver brazing, temperatures of up to 1300° F. or more may be used. The diameters of the port an nozzle are selected for good capillary flow of the brazing, and in some embodiments, the radial gap between the nozzle body and bit body may be about 0.0015 and 0.003 inches, or another suitable size. During brazing, it may be helpful to rotate the nozzle 301 being brazed back and forth slightly in an oscillating manner within the port, about the longitudinal axis of the nozzle, to ensure distribution of the brazing to all mating surfaces of the nozzle 301 and the bit 300. Once the brazing has been applied, the heat source is removed and the bit and nozzle are allowed to cool.

As was mentioned in the discussion of FIG. 5 above, the nozzle 301 may include two portions 501 and 502 of different diameters, meeting at location 503, which may be a step transition in diameter or another relatively abrupt transition. This transition provides a break in the capillary action of the molten brazing flowing in the gap between the nozzle 301 and the bit 300. That is, the brazing may penetrate the port only to the depth of the transition at location 503. This may facilitate removal of the nozzle 301 should it become necessary, because the body of the drill bit 300 will only have to be heated above the melting temperature of the brazing to the depth of the diameter transition of the nozzle 301. In some embodiments, the outer diameter of the first portion 501 of the nozzle 301 may be about 0.030 inches smaller than the outer diameter of the second portion 502, or another amount sufficient to provide a break in capillary action.

Figure 10:
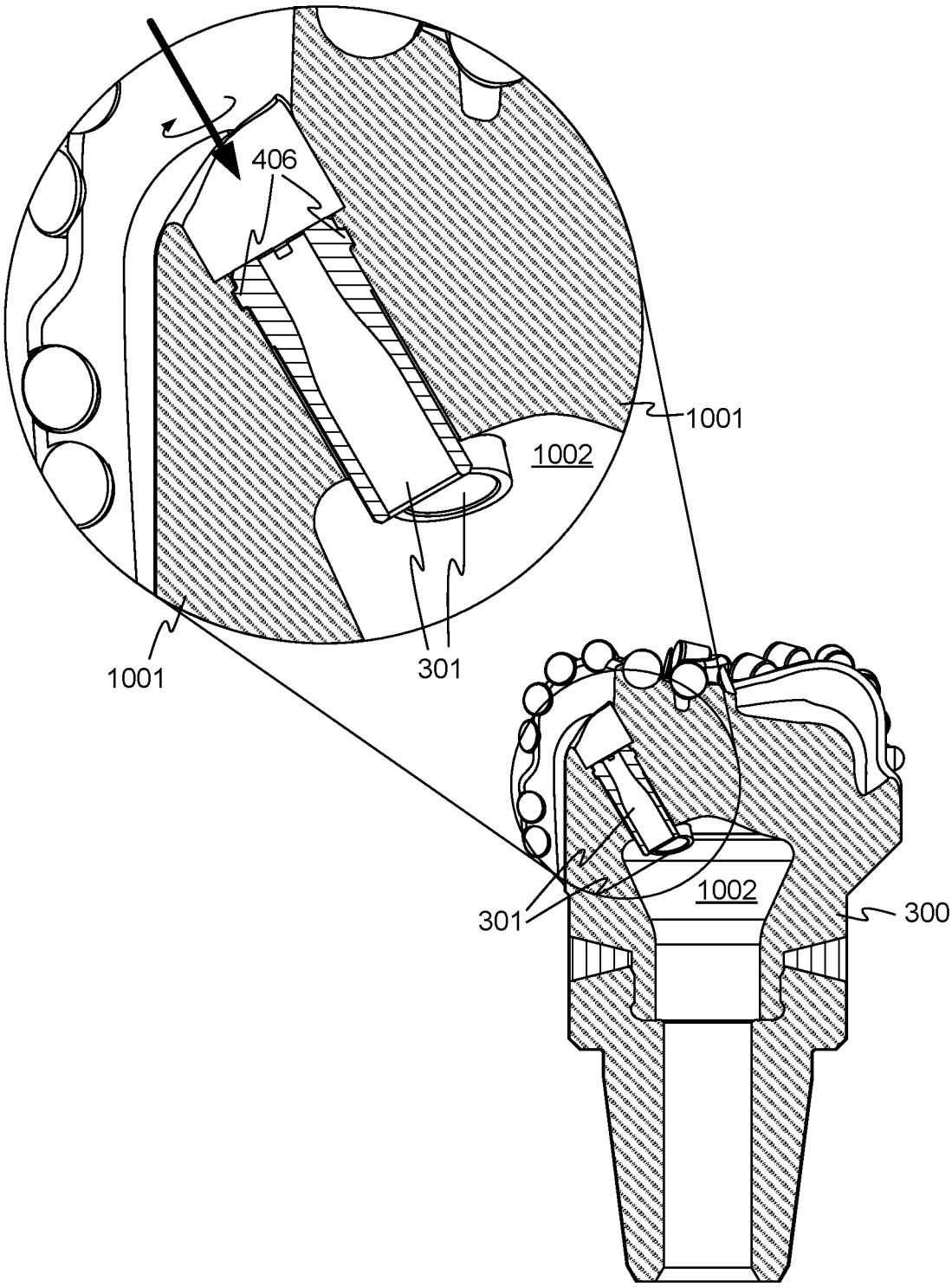
FIG. 10 shows a cross section view of the drill bit of FIG. 3, with nozzles fully inserted into the bit.

FIG. 10 shows a cross section view of the drill bit 300, with two nozzles 301 fully inserted into the bit 300. The nozzle 301 has been rotated about its longitudinal axis such that the lobes 406 of the exposed nozzle 301 are engaged with the corresponding undercut groove 602, to help prevent the nozzle 301 from being ejected from the bit 300. Preferably, the nozzles 301 are long enough that they extend entirely through the wall 1001 of the drill bit 300, into the interior plenum 1002. This arrangement protects the edges of the ports into which the nozzles 301 are inserted from erosion due to flow of the drilling fluid through the ports.

While only two of the nozzles 301 are shown in FIG. 10, it will be recognized that any workable number of nozzles embodying the invention may be inserted into a drill bit. Nozzles embodying the invention may be used in conjunction with other kinds of nozzles. For example, a drill bit including nozzles embodying the invention may also include one or more conventional nozzles, such as nozzles threaded into the bit body or inserted into the bit body from inside the bit plenum.

The invention has now been described in detail for the purposes of clarity and understanding. However, those skilled in the art will appreciate that certain changes and modifications may be practiced within the scope of the appended claims. It is to be understood that any workable combination of the features and capabilities disclosed above in the various embodiments is also considered to be disclosed.

What is claimed is:

1. A nozzle for a drill bit, the nozzle comprising:

a nozzle body, wherein the nozzle body is generally cylindrical and comprises a longitudinal axis, a proximal end for insertion into a drill bit body, and a distal end opposite the proximal end, and wherein the nozzle body defines a longitudinal bore through the nozzle along the longitudinal axis;

one or more lobes extending radially from the nozzle body near the distal end, wherein each of the one or more lobes is displaced axially from the distal end such that a cylindrical portion of the nozzle body is disposed between the distal end and the lobe, and wherein each lobe extends from and is surrounded by an outer cylindrical surface of the nozzle body, and wherein the outer cylindrical surface extends both proximally and distally from each lobe, and wherein each of the one or more lobes comprises a cylindrical outer surface centered on the longitudinal axis of the nozzle body and having a larger radius than the portion of the nozzle body from which the lobe extends; and a fitting in the distal end configured to engage a tool for imparting rotational torque to the nozzle about the longitudinal axis.

2. The nozzle of claim 1, wherein the one or more lobes comprise at least two lobes diametrically opposed on the nozzle body.

3. The nozzle of claim 1, wherein each of the one or more lobes has an angular extent of between 30 and 60 degrees as measured around the longitudinal axis of the nozzle.

4. The nozzle of claim 1, wherein the longitudinal bore has a larger cross sectional area at the proximal end of the nozzle than at the distal end of the nozzle.

5. The nozzle of claim 4, wherein the longitudinal bore comprises a cylindrical section at the proximal end of the nozzle, the cylindrical section being centered on the longitudinal axis of the nozzle and having a diameter of at least 70 percent of the outside diameter of the nozzle body at the proximal end of the nozzle.

6. The nozzle of claim 1, wherein the fitting is a transverse slot.

7. The nozzle of claim 1, wherein the fitting is a polygonal recess.

8. The nozzle of claim 1, wherein each lobe extends from the cylindrical outer surface of the nozzle body by no more than 0.100 inches.

9. A nozzle for a drill bit, the nozzle comprising:

a nozzle body, wherein the nozzle body is generally cylindrical and comprises a longitudinal axis, a proximal end for insertion into a drill bit body, and a distal end opposite the proximal end, and wherein the nozzle body defines a longitudinal bore through the nozzle along the longitudinal axis;

one or more lobes extending radially from the nozzle body near the distal end, wherein each of the one or more lobes is displaced axially from the distal end such that a cylindrical portion of the nozzle body is disposed between the distal end and the lobe, and wherein each lobe extends from and is surrounded by an outer cylindrical surface of the nozzle body, and wherein the outer cylindrical surface extends both proximally and distally from each lobe; and a fitting in the distal end configured to engage a tool for imparting rotational torque to the nozzle about the longitudinal axis, wherein:

the nozzle body comprises a first nozzle portion at the distal end, the first nozzle portion having a first radius;

the nozzle body comprises a second nozzle portion at the proximal end, the second nozzle portion having a second radius smaller than the first radius; and the first nozzle portion and the second nozzle portion meet at a location between the proximal and distal ends.

10. The nozzle of claim 9, wherein the first nozzle portion and the second nozzle portion meet in a step transition of radius.

11. A drill bit, comprising:

a nozzle comprising:

a nozzle body, wherein the nozzle body is generally cylindrical and comprises a longitudinal axis, a proximal end for insertion into a drill bit body, and a distal end opposite the proximal end, and wherein the nozzle body defines a longitudinal bore through the nozzle along the longitudinal axis;

one or more lobes extending radially from the nozzle body near the distal end, wherein each of the one or more lobes is displaced axially from the distal end such that a cylindrical portion of the nozzle body is disposed between the distal end and the lobe, and wherein each lobe extends from and is surrounded by an outer cylindrical surface of the nozzle body, and wherein the outer cylindrical surface extends both proximally and distally from each lobe, and wherein each of the one or more lobes comprises a cylindrical outer surface centered on the longitudinal axis of the nozzle body and having a larger radius than the portion of the nozzle body from which the lobe extends; and a fitting in the distal end configured to engage a tool for imparting rotational torque to the nozzle about the longitudinal axis; and the drill bit body, wherein the drill bit body comprises:

an exterior surface and an interior plenum, wherein the drill bit body defines a port through the drill bit body from the exterior surface to the interior plenum, the port being generally cylindrical and of a size to receive the nozzle body, the port having an undercut groove defining an enlarged section of the port, the groove being of a size to receive the one or more lobes of the nozzle within the groove, and the drill bit body defining one or more gaps in the drill bit body positioned at an edge of the port, the one or more gaps being of a shape and size to receive the one or more lobes of the nozzle; and a plurality of cutters on the drill bit body;

wherein the nozzle is disposed in the drill bit body with the lobes captured within the undercut groove.

12. The drill bit of claim 11, wherein the drill bit body is made of steel.

13. The drill bit of claim 11, wherein the drill bit body is made of a carbide matrix.

14. The drill bit of claim 11, wherein the nozzle is brazed into the drill bit body.

15. The drill bit of claim 11, wherein the drill bit body defines two gaps for receiving the lobes of the nozzle, and wherein the gaps are arranged longitudinally within a junk slot of the drill bit body.

16. The drill bit of claim 11, wherein the nozzle body protrudes into the plenum of the drill bit body.

17. The drill bit of claim 11, wherein the drill bit comprises a plurality of nozzles.

18. The drill bit of claim 11, wherein the drill bit is a polycrystalline diamond compact (PDC) drag bit.

19. A method of installing a nozzle in a drill bit, the method comprising:

providing a nozzle, the nozzle comprising:

a nozzle body, wherein the nozzle body is generally cylindrical and comprises a longitudinal axis, a proximal end for insertion into a drill bit body, and a distal end opposite the proximal end, and wherein the nozzle body defines a longitudinal bore through the nozzle along the longitudinal axis;

one or more lobes extending radially from the nozzle body near the distal end, wherein each of the one or more lobes is displaced axially from the distal end such that a cylindrical portion of the nozzle body is disposed between the distal end and the lobe, and wherein each of the one or more lobes comprises a cylindrical outer surface centered on the longitudinal axis of the nozzle body and having a larger radius than the portion of the nozzle body from which the lobe extends; and a fitting in the distal end configured to engage a tool for imparting rotational torque to the nozzle about the longitudinal axis;

providing the drill bit body, the drill bit body comprising;

an exterior surface and an interior plenum, wherein the drill bit body defines a port through the drill bit body from the exterior surface to the interior plenum, the port being generally cylindrical and of a size to receive the nozzle body, the port having an undercut groove defining an enlarged section of the port, the groove being of a size to receive the one or more lobes of the nozzle within the groove, and the drill bit body defining one or more gaps in the drill bit body positioned at an edge of the port, the one or more gaps being of a shape and size to receive the one or more lobes of the nozzle; and a plurality of cutters on the drill bit body;

inserting the nozzle into the port defined in the drill bit body from outside the drill bit body such that the one or more lobes pass through the gaps to reach the groove;

rotating the nozzle about its longitudinal axis such that the one or more lobes of the nozzle are axially captured within the groove; and brazing the nozzle to the drill bit body.

20. The method of claim 19, wherein inserting the nozzle into the port comprises inserting the nozzle into the port such that the proximal end of the nozzle extends into the interior plenum of the drill bit body.

21. The method of claim 19, further comprising rotating the nozzle in an oscillating manner about its longitudinal axis during at least part of the brazing step.

* * * * *